109-82 SP
10/5/76 XR 3,983,672

United States Patent [19]

Dietrich

[11] 3,983,672

[45] Oct. 5, 1976

[54] WALL

[76] Inventor: Richard J. Dietrich, Adalbertstrasse 8, Munich 13, Germany

[22] Filed: Nov. 21, 1973

[21] Appl. No.: 417,840

Related U.S. Application Data

[63] Continuation of Ser. No. 241,263, April 5, 1972, abandoned.

[30] Foreign Application Priority Data

Apr. 5, 1971 Germany ..... 2116578

[52] U.S. Cl. ..... 52/238; 52/408; 52/411; 109/82

[51] Int. Cl.[2] ..... E04B 2/06; E04B 2/08

[58] Field of Search ..... 52/615, 618, 586, 408, 52/411, 413, 232, 238, 242, 479

[56] References Cited

UNITED STATES PATENTS

| | | | |
|---|---|---|---|
| 690,435 | 1/1902 | John | 52/445 |
| 706,348 | 8/1902 | Simpson | 52/240 |
| 1,191,871 | 7/1916 | Carrick | 52/241 |
| 1,595,673 | 8/1926 | Magney | 52/240 |
| 1,890,023 | 12/1932 | Schroder | 52/445 |
| 2,018,911 | 10/1935 | Brill | 52/232 |
| 2,175,630 | 10/1939 | Kiesel | 52/615 |
| 2,231,216 | 2/1941 | Nystrom | 52/618 |
| 2,250,582 | 7/1941 | Jentzer | 52/618 |
| 2,582,144 | 1/1952 | Miles | 52/618 |
| 2,757,116 | 7/1956 | MacMillan | 52/615 |
| 2,960,196 | 11/1960 | Mesrole | 52/615 |
| 3,134,464 | 5/1964 | Markle | 52/615 |
| 3,217,455 | 11/1965 | Barges | 52/404 |
| 3,231,451 | 1/1966 | Gazzelle | 52/408 |
| 3,343,314 | 9/1967 | Smith | 52/615 |
| 3,378,951 | 4/1968 | Malone | 52/615 |
| 3,412,518 | 11/1968 | Waite | 52/404 |
| 3,462,905 | 8/1969 | Regiel | 52/404 |
| 3,490,187 | 1/1970 | Stauffer | 52/586 |
| 3,553,921 | 1/1971 | Breistein | 52/615 |
| 3,572,000 | 3/1971 | Gustavsson | 52/404 |

FOREIGN PATENTS OR APPLICATIONS

| | | | |
|---|---|---|---|
| 1,335,141 | 7/1963 | France | 52/446 |

OTHER PUBLICATIONS

The Condensed Chemical Dictionary c. 1956 pp. 1012, 1013.

*Primary Examiner*—Ernest R. Purser
*Assistant Examiner*—Henry Raduazo
*Attorney, Agent, or Firm*—Sughrue, Rothwell, Mion, Zinn and Macpeak

[57] ABSTRACT

A wall constructed with several layers to form a fire resisting and thermally insulating unit; in one form the unit is formed with a central steel supporting layer on either side of which insulating panels are fixed; this is then clamped in a top and bottom bracket for securing to a floor and ceiling; facing panels are then secured onto the assembly: in a further form there are two steel reinforcing layers and an insulating layer as a core in between the supporting layers; the panels can be assembled for use as non load-bearing exterior walls or partitions.

28 Claims, 1 Drawing Figure

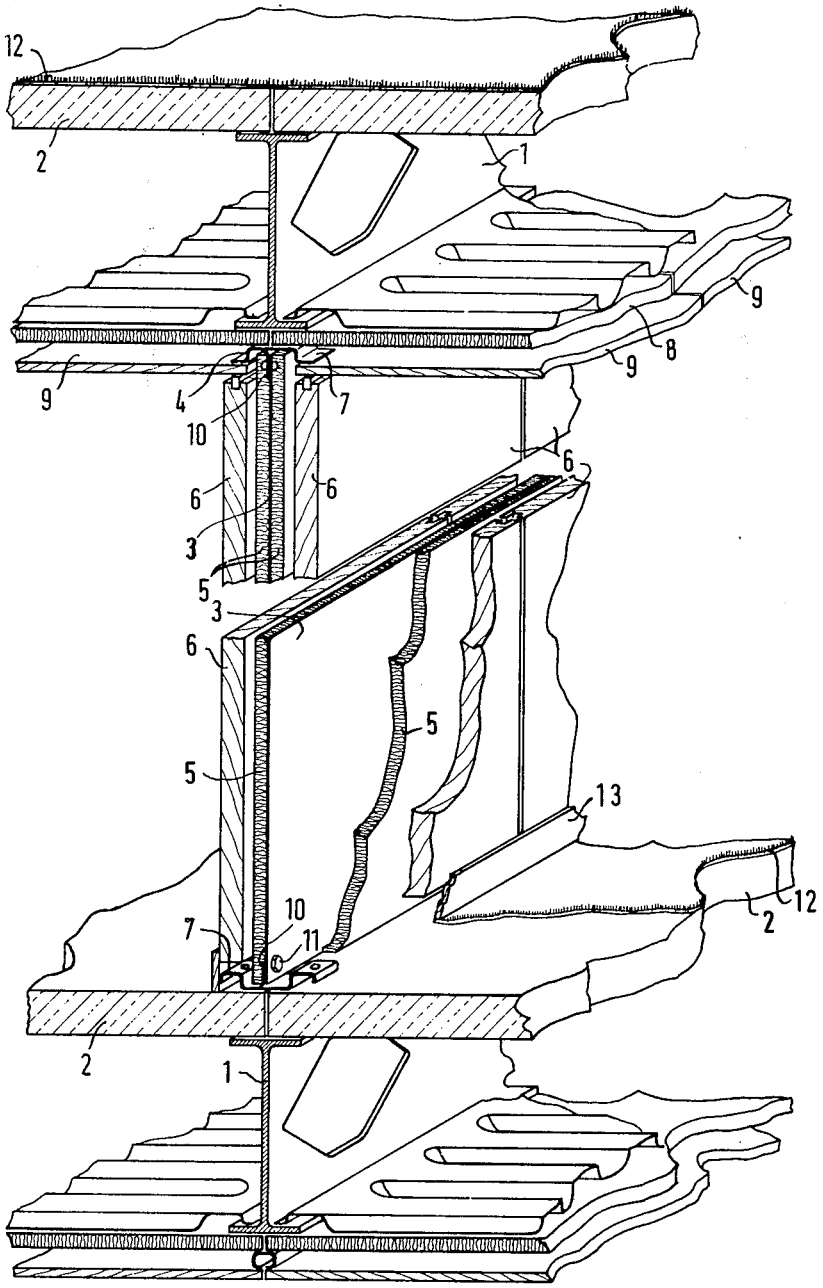
12
2
1
9
8
9
9
4
7
10
6
6
6
3
5
3
6
5
5
13
12
2
7
10
11
2
1

WALL

This is a continuation of application Ser. No. 241,263 filed Apr. 5, 1972, now abandoned.

The invention relates to a wall which may be a partition or non-load bearing wall, and which can be used for buildings or ship construction, consisting of several layers of which at least one is fire-resistant and heat-insulating.

Recently increasing demands have arisen for such partitions which are light in weight, may be installed, removed or re-positioned rapidly, thus enabling room plans to be varied within skeletal frame structures. Although there are numerous known light and rapidly installed partitions (see Walter Henn "Die Trennwand" Calway-Verlag, Munich, 1969), these are either unsatisfactory with respect to fire-resistance and heat or sound insulation or else they are very complex in their construction.

Accordingly, the invention has as an object a partition or non-bearing wall which may easily be set up, taken down and re-positioned, which is as simple in structure as possible, and is inexpensive to produce whilst nevertheless providing the necessary fire-resistance and strength conditions.

The present invention consists in a wall comprising several layers, of which at least one is a fire-resistant and thermally insulating layer, a further layer consists of at least one thin supporting flat element of material of high tensile strength, which element has its edges secured in a building or ship in the manner of a diaphragm, wherein the or each fire-resistant and thermally insulating layer is fastened on both sides of the supporting panel-like element.

A layer described as fire-resistant and thermally insulation should be understood as meaning a layer which will withstand the action of flames acting on the same for at least 90 minutes, in such manner that the flames cannot reach the flat element situated behind the same, and which ensures moreover that the heat of the flames is transmitted to the flat element at such reduced temperature only as may be withstood by the latter without alteration of its space-delimiting action. Among others, mineral wool, reinforced concrete in the form of slabs or panels, and the like, may be considered as materials for this layer. This layer or these layers protects or protect the flat element against destruction by the heat of a fire, and at the same time prevents or prevent an inadmissible temperature rise at the far side of the wall from the fire, which could result in ignition of combustible substances or objects which may be present at the far side of the wall.

The clamping of the edges of the flat element in the manner of a diaphragm when assembled in the building may be carried out, for example, adjacent the floors of the building or building framework.

By virtue of its clamping within the building, this flat element is stable enough to withstand the mechanical stresses which may be determined experimentally in conjunction with fire-resistance by ball impact or lead-shot bag tests, and thus assures the space-delimiting function of the wall in any event. If the or each flat element is constructed as an uninterrupted and unperforated slab or panel, it acts as a vapour diffusion barrier which is of importance in particular in the case of a considerable indoor or outdoor temperature gradient. The fire-resistant and thermally insulating layers fastened on the flat element may on the other hand simultaneously improve sound-damping, especially if these layers will absorb wind noise, since they act in oscillation-damping manner on the flat element which, for its part, represents a very effective means of separating a room within a building by virtue of its density and intrinsic weight. This effect may be improved by measures taken to increase its intrinsic weight.

One embodiment of the wall according to the invention merely comprises a thin flat element with fire-resistant and thermally insulating layers fastened on both of its sides. A form of wall according to the invention is also possible, however, which comprises two of said thin flat elements, wherein fire-resistant and thermally insulating layers may be secured to these two elements. The or each thin flat element may consist of uninterrupted or unperforated sheet steel, or else of lattice-like sheet steel, which may have a thickness of for example only approximately 1 mm. The fire-resistant and thermally insulating layers may be glued on the supporting flat element by means of waterglass adhesive, which is cheap and fire-resistant. Facing wall panels in the form of plates or sheets are appropriately arranged on the external sides of the outer fire-resistant and thermally insulating layers. These wall panels may be fastened on the aforesaid layers, or may be affixed separately in the building at the outer sides of these layers. Since the partition or non-bearing wall according to the invention is already self-supporting without these wall shells or panels, these wall shells may be considered as facings, so that any materials including even combustible materials may be employed for these. Cheap wooden shells, for example of chipboard or other press-board, may be employed if required.

The application of wall shells of wood or wood-like or analogous combustible substances in conjunction with walls which must be fire-resistant according to building regulations, such as are specified for high-rise building constructions, has been rendered possible according to the invention by means of the wall design, which comprises a thin flat element of high tensile strength inserted membrane-like in the building and situated inside the wall, and having fire-resistant and thermally insulating layers arranged on it.

In case of modest demands in respect of surface sound damping and stability, it is also possible to affix screening sheets on the external fire-resistant and thermally insulating layers of the wall, instead of covering wall shells or panels.

A form of embodiment of the wall according to the invention is also possible which comprises not only one thin, panel-like flat element inserted in the building, but two such flat elements between which is a layer or a core consisting of a fire-resistant and a thermally insulating layer bonded to both flat elements. To this end, the insertion of the two flat elements is performed in such manner that the bearing capacity of the flat element facing away from the flames is not altered by the deformations of the flat element at the side of the flames. The damping core still supported by the flat element facing away from the fire even after destruction of the element at the side of the flames will protect the flat element facing away from the fire, so that this may continue to comply with requirements in respect of strength.

A form of embodiment of the wall according to the invention, given by way of example, and its arrangement and fastening within a building, which are described in particular in the following, are shown in the drawing in an oblique vertically sectioned view.

According to this form of the invention, a thin panel-like flat element 3 consisting of uninterrupted sheet steel panels set coincidently beside each other, have their upper and lower edges secured in the manner of a diaphragm in the building between the upper floor beam 1 and the flooring slabs 1 resting on the lower floor beam 1. The fastening of the edges of the sheet steel panels 3 is performed by means of fastening mountings 4 which are joined to the floor beams 1 and flooring slabs 2 along the edges of the sheet steel panels 3. The fastening mounting or bracket situated at the lower edge of the flat element 3 is secured on the flooring slabs 2 resting on the beams 1 which slabs may for example consist of expanded (aerated) concrete, whereas the upper fastening bracket is situated below mineral wool panels 8 forming a protective layer against combustion and secured to the underside of the upper beam 1, and is fastened to the actual beam either direct or through these panels. In the same way as the lower bracket, the upper fastening bracket 4 situated at the upper edge of the panel-like flat element 3 is approximately U-shaped in cross-section and on its two branches has outwardly bent flanges 7 on which facing panels 9 consisting of a wood-based material are fastened, for example. The fastening brackets 4 moreover have a central web 10 which is positioned laterally beside the panel-like flat element and to which this element is secured by means of fastening bolts 11, for example in the form of screws.

The flat element inserted in the building may also consist of a single sheet steel panel extending throughout the wall length, instead of several laterally coincident sheet steel panels. The sheet steel panel or panels may, if need be, have its or their lateral edges secured in the building, and not only its or their upper and lower edges. This may be performed, e.g., by fastening to building columns or transverse walls.

Mineral wool panels 5, which preferably have a thickness of approximately 30 mms, are glued on each side of the sheet steel panels. The fastening of these "mats" on the sheet steel panel which is appropriately of no more than approximately 1 mm gauge, may appropriately be performed by means of water glass adhesive, which is particularly appropriate in view of its resistance to fire. Wall shells 6, which in this embodiment consist of chip-board panels joined together by groove-and-tongue joints and have a thickness or approximately 60 cms, are arranged to cover the mineral wool panels 5 on both sides of the wall and merely act as facings. A particularly light weight form of wall construction is obtained if expanded chipboard is employed.

Instead of wall shells separately set up and secured in the building, it is also possible to employ sheet material or thin self-supporting wall shells, which may for example be secured on the fire-resistant and thermally insulating layers 5 by means of adhesive.

A carpet 12 may be laid on the actual flooring slabs 2. The facing wall shells or panels terminate in a skirting board 13 at the floor or carpeting 12.

The wall according to the invention may be used for an outer side of a building, for which purpose it is possible to replace one wall panel 6 by the outer wall of the building.

I claim:

1. A prefabricated multi-layer wall comprising:

1. a flat supporting element approximately 1 mm thick formed from a material of high tensile strength, said supporting element having at least two edge surfaces and being made stable enough to withstand the mechanical stresses to which the wall may be subjected during a fire by means to be recited;
2. a fire-resistant and thermally insulating layer fastened to each side of said supporting element, said fire-resistant layer being capable of withstanding the action of flames thereon for at least 90 minutes, in such manner that the flames cannot reach said supporting element and in such manner that the heat of the flames is transmitted to said supporting element only at such reduced temperature as may be withstood by said supporting element without alteration of its space-delimiting action;
3. a covering wall shell or facing in the form of a panel or sheet covering at least one of said insulating layers, said shell or facing
   a. being in facing relationship with said at least one of said insulating layers along the interface therebetween and
   b. being self-supporting and capable of being fastened in said supporting structure independently of said one of said layers; and
4. means for clamping said supporting element to a supporting structure in the manner of a diaphragm, said means comprising at least a pair of clamping means each having a web vertically projecting from a base member and means securing said edges of said supporting element beside said web of said clamping means, whereby said supporting element is made stable enough to withstand mechanical stresses.

2. A wall as claimed in claim 1 wherein said flat element is formed from an uninterrupted sheet.

3. A wall as claimed in claim 1 wherein said fire-resistant and thermally insulating layers are glued to said flat element.

4. A wall as claimed in claim 3 wherein the fire-resistant and thermally insulating layers are glued on with waterglass adhesive.

5. A wall as claimed in claim 1 wherein the fire-resistant and thermally insulating layers are composed of mineral wool.

6. A wall as claimed in claim 1 wherein said shell is fastened directly to said one of said layers.

7. A wall as claimed in claim 1 wherein said flat element is adapted to be secured in said supporting structure only at its upper and lower edges.

8. A prefabricated multi-layer wall comprising:

1. a flat supporting element approximately 1 mm thick formed from a material of high tensile strength, said supporting element having at least two edge surfaces and being made stable enough to withstand the mechanical stresses to which the wall may be subjected during a fire by means to be recited;
2. a fire-resistant and thermally insulating layer fastened to each side of said supporting element, said fire-resistant layer being capable of withstanding the action of flames thereon for at least 90 minutes, in such manner that the flames cannot reach said supporting element and in such manner that the heat of the flames is transmitted to said supporting element only at such reduced temperature as may be withstood by said supporting element without alteration of its space-delimiting action;

3. a covering wall shell or facing in the form of a panel or sheet formed from sheeted chipboard panels and covering at least one of said insulating layers, said shell or facing being in facing relationship with said at least one of said insulating layers along the interface therebetween; and 4. means for clamping said supporting element to a supporting structure in the manner of a diaphragm, said means comprising at least a pair of clamping means each having a web vertically projecting from a base member and means securing said edges of said supporting element beside said web of said clamping means, whereby said supporting element is made stable enough to withstand mechanical stresses.

9. A wall as claimed in claim 8 wherein said flat element is formed from an uninterrupted sheet.

10. A wall as claimed in claim 8 wherein said fire-resistant and thermally insulating layers are glued to said flat element.

11. A wall as claimed in claim 10 wherein the fire-resistant and thermally insulating layers are glued on with waterglass adhesive.

12. A wall as claimed in claim 8 wherein the fire-resistant and thermally insulating layers are composed of mineral wool.

13. A wall as claimed in claim 8 wherein said shell is fastened directly to said one of said layers.

14. A wall as claimed in claim 8 wherein said flat element is adapted to be secured in said supporting structure only at its upper and lower edges.

15. A prefabricated multi-layer wall comprising:

1. a flat supporting element approximately 1 mm thick formed from a material of high tensile strength, said supporting element having at least two edge surfaces and being made stable enough to withstand the mechanical stresses to which the wall may be subjected during a fire by means to be recited;

2. a fire-resistant and thermally insulating layer fastened to each side of said supporting element, said fire-resistant layer being capable of withstanding the action of flames thereon for at least 90 minutes, in such manner that the flames cannot reach said supporting element and in such manner that the heat of the flames is transmitted to said supporting element only at such reduced temperature as may be withstood by said supporting element without alteration of its space-delimiting action;

3. a covering wall shell or facing in the form of a plurality of panels or sheets releasably connected by tongue-and-groove joints and covering at least one of said insulating layers, said shell or facing being in facing relationship with said at least one of said insulating layers along the interface therebetween; and 4. means for clamping said supporting element to a supporting structure in the manner of a diaphragm, said means comprising at least a pair of clamping means each having a web vertically projecting from a base member and means securing said edges of said supporting element beside said web of said clamping means, whereby said supporting element is made stable enough to withstand mechanical stresses.

16. A wall as claimed in claim 15 wherein said flat element is formed from an uninterrupted sheet.

17. A wall as claimed in claim 15 wherein said fire-resistant and thermally insulating layers are glued to said flat element.

18. A wall as claimed in claim 15 wherein the fire-resistant and thermally insulating layers are glued on with waterglass adhesive.

19. A wall as claimed in claim 15 wherein the fire-resistant and thermally insulating layers are composed of mineral wool.

20. A wall as claimed in claim 15 wherein said shell is fastened directly to said one of said layers.

21. A wall as claimed in claim 15 wherein said flat element is adapted to be secured in said supporting structure only at its upper and lower edges.

22. A prefabricated multi-layer wall comprising:

1. a flat supporting element formed from thin-gauge sheet steel approximately 1 mm thick,
   said supporting element having at least two edge surfaces and being made stable enough to withstand the mechanical stresses to which the wall may be subjected during a fire by means to be recited;

2. a fire-resistant and thermally insulating layer fastened to each side of said supporting element, said fire-resistant layer being comprised of mineral wool panels considerably thicker than said flat element and being capable of withstanding the action of flames thereon for at least 90 minutes, in such manner that the flames cannot reach said supporting element and in such manner that the heat of the flames is transmitted to said supporting element only at such reduced temperature as may be withstood by said supporting element without alteration of its space-delimiting action;

3. a covering wall shell or facing in the form of an expanded chipboard panel or sheet covering at least one of said insulating layers, said shell or facing being in facing relationship with said at least one of said insulating layers along the interface therebetween; and 4. means for clamping said supporting element to a supporting structure in the manner of a diaphragm, said means comprising at least a pair of clamping means each having a web vertically projecting from a base member and means securing said edges of said supporting element beside said web of said clamping means, whereby said supporting element is made stable enough to withstand mechanical stresses.

23. A wall as claimed in claim 22 wherein said flat element is formed from an uninterrupted sheet.

24. A wall as claimed in claim 22 wherein said fire-resistant and thermally insulating layers are glued to said flat element.

25. A wall as claimed in claim 22 wherein the fire-resistant and thermally insulating layers are glued on with waterglass adhesive.

26. A wall as claimed in claim 22 wherein the fire-resistant and thermally insulating layers are composed of mineral wool.

27. A wall as claimed in claim 22 wherein said sheet is fastened directly to said one of said layers.

28. A wall as claimed in claim 22 wherein said flat element is adapted to be secured in said supporting structure only at its upper and lower edges.

* * * * *